United States Patent [19]

Boehm

[11] Patent Number: 4,897,300

[45] Date of Patent: Jan. 30, 1990

[54] SECURITY PAPER

[75] Inventor: Michael Boehm, Heimstetten, Fed. Rep. of Germany

[73] Assignee: GAO Gesellschaft fuer Automation und Organisation mbH, Munich, Fed. Rep. of Germany

[21] Appl. No.: 228,896

[22] Filed: Aug. 4, 1988

[30] Foreign Application Priority Data

Aug. 19, 1987 [EP] European Pat. Off. ..... 87112042.4

[51] Int. Cl.[4] ..... B05D 3/02

[52] U.S. Cl. ..... 428/195; 428/292; 428/294; 428/375; 428/704; 428/908; 428/915; 428/916; 428/690; 283/85; 283/904

[58] Field of Search ..... 428/195, 908, 915, 704, 428/292, 294, 375, 916, 690; 283/85, 904

[56] References Cited

U.S. PATENT DOCUMENTS

| | | | |
|---|---|---|---|
| 4,183,989 | 1/1980 | Tooth | 428/900 |
| 4,442,170 | 4/1984 | Kaule et al. | 428/908 |
| 4,451,521 | 5/1984 | Kaule et al. | 428/908 |
| 4,451,530 | 5/1984 | Kaule et al. | 428/908 |
| 4,452,843 | 6/1984 | Kaule et al. | 428/908 |
| 4,756,557 | 7/1988 | Kaule et al. | 428/915 |

FOREIGN PATENT DOCUMENTS

| | | |
|---|---|---|
| 0003187 | 1/1979 | European Pat. Off. . |
| 0007383 | 2/1979 | European Pat. Off. . |

OTHER PUBLICATIONS

CA 110 (2): 9979y, Osada et al, 2-4-87.

*Primary Examiner*—Ellis P. Robinson
*Assistant Examiner*—P. J. Ryan
*Attorney, Agent, or Firm*—Foley & Lardner, Schwartz, Jeffery, Schwaab, Mack, Blumenthal & Evans

[57] ABSTRACT

The invention relates to a security paper having a security thread embedded therein, running from edge to edge, that is printed with luminescent colors in such a way that they are invisible in normal lighting. The luminescent colors are provided along the security thread in successive overlapping portions which, when the colors are excited, have a length recognizable to the naked eye and show characteristic mixed fluorescences in the overlapping areas.

15 Claims, 1 Drawing Sheet

SECURITY PAPER

Figure 1:
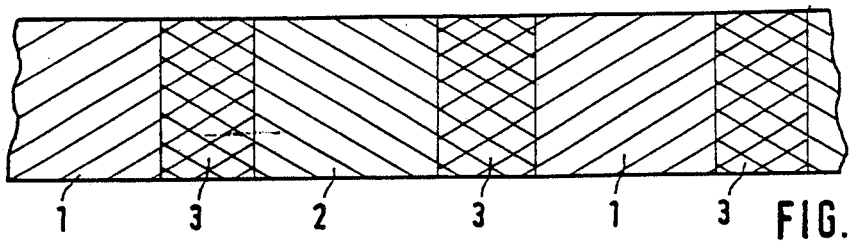

The present invention relates to a security paper, in particular a bank note, having embedded therein, running from edge to edge, a security thread that is printed with luminescent colors.

It has been known for some time to protect such papers by security threads that are embedded in the paper during the production process.

The security threads have of course become increasingly sophisticated in the course of time. Numerous proposals have become known in this connection to equip security threads with certain properties, so that not only the presence of the security thread alone but also the presence of the special properties guarantee the authenticity of the paper in question. For example, DE-A 14 46 851 describes a security thread having a microprint executed in several colors. The printing inks can also be fluorescent. The areas printed with different colors are so small or so close together that they cannot be distinguished by the naked eye or appear to the viewer as one uniform color. The microprint or the different colors can only be recognized with the aid of a magnifying glass or a microscope.

It is regarded as a disadvantage of this known security thread that either the authenticity characteristics are relatively difficult to identify for a layman, or a forger can deceive laymen by merely imitating the general perceived color created by the microareas of different colors indistinguishable to the naked eye since, as explained above, a counterfeit can only be detected under a magnifying glass or a microscope. Furthermore, the colored thread may disturb the esthetic impression of a printed pattern, which is disadvantageous in particular in the case of bank notes. On the other hand, if the security thread itself is disposed in the printed area of the bank note, the printed pattern of the bank note is also disturbing during identification of the microprint applied to the security thread. The known thread is therefore unsuitable for random placement in the security paper and for simple visual authenticity testing.

The invention is based on the problem of providing a security thread for an antifalsification or security paper which is inconspicuous in normal lighting and therefore does not disturb the appearance of the security paper, but still has a characteristic, easily tested marking that can be used to prove the authenticity of the security thread, and thus of the corresponding security paper, in a simple manner.

This problem is solved by using luminescent colors that are invisible in normal lighting and are provided along the security thread in successive and overlapping portions which, when the colors are excited, have a length recognizable to the naked eye and, each printed with different luminescent colors, result in the overlapping areas in characteristic mixed luminescences.

The compound color that comes about in the overlapping areas preferably runs smoothly and continuously into the colors of the portions including the overlapping area.

The desired effect obtainable according to the invention comes about particularly clearly and impressively when the luminescent colors are selected in such a way that the successive portions are printed with the basic colors of the additive color mixture, so that the particular compound colors also come about in an almost pure form in the overlapping areas. For example, the portions are printed with luminescent colors that emit red, green and/or blue, whereby the overlapping areas appear orange, green and/or violet. One can select the succession of the colors in particular so as to produce the order of colors in the natural spectrum, resulting in a kind of rainbow effect.

The inventive security thread has not only this special esthetic effect but also a high protection value, since it is very difficult to imitate. A forger must first analyze several colors and imitate them accordingly. The compound colors which occur in the overlapping areas due to the mixed luminescence present there are extremely difficult to reconstruct, since basic colors with only slightly different emission spectra cause a great shift in the mixed fluorescence. Due to the neutral color in the unexcited state and the necessary high luminosity in the excited state, only identical luminescent colors are suitable. Such colors are usually not used, however, so that they are virtually unavailable on the market and must be specially produced. All in all, a forger attempting to reconstruct the security thread is therefore faced with a number of physical and technical problems that are difficult to overcome and make imitation or forgery almost impossible.

In spite of the high security standard, the thread can still be tested for authenticity without any difficulty. The corresponding security paper need only be exposed to UV radiation. It is relatively easy to provide such a light source at a bank counter and test bank notes inconspicuously with it. One can even consider providing the light source below the table and performing the fluorescence excitation through a plate set in the table that is only permeable to ultraviolet light, so that the customer notices the fluorescence testing even less or not at all. It is thus unnecessary to use a microscope, for example, which is troublesome, time-consuming, embarrasses the customer and can hardly be performed at a bank counter. UV radiation sources are also available as hand devices, resembling flashlights, allowing for the authenticity of the security paper to be detected clearly and reliably in any place. It is also helpful that the authenticity feature is one that has an easily remembered effect even for laymen. In UV light, the formerly colorless, inconspicuous security thread suddenly acquires an intensely colorful effect, the colors following each other for example in the order of the natural spectrum. If the same, normal colors are provided in the vicinity of the security thread or at another place in the printed pattern—ideally present in the same order, it is also possible to compare them directly with the colors of the security thread. Automatic testing by appropriate detectors is of course also possible.

Fluorescent substances which are suitable for the inventively proposed printing inks are basically known, although they are difficult to obtain on the market. For example, DE-B 30 32 611 discloses rare earth metal salt phosphors which emit red and green, EP-A 0 007 383 describes blue-emitting europium-doped phosphors and, finally, US-A 3,525,698 describes rare earth metals phosphates which emit luminous green. For the selection of suitable phosphors, explicit reference is made to the disclosure of these publications; but this does not rule out the use of other phosphors provided they meet the inventive requirements. One must make sure that the perceived color is white or the substances are colorless and transparent, the substances have fluorescence emissions that can be distinguished well from each other and these emissions also differ characteristically from each other in their mixed forms. Particularly suitable colors are those having high color purity and emission spectra corresponding, if possible, to the ideal values of the additive color mixture. Obviously, one must also ensure resistance to environmental influences.

Instead of the above-mentioned fluorescent substances, phosphorescent colors can also be used. The superimposed printing of these colors in the overlapping area can lead to a color change here due to differences in the afterglow times. This color change is then a further criterion for authenticity that adds to the difficulty of forging. Such phosphorescent colors are described, for example, in EP-A 0 003 187. Explicit reference is also made to the disclosure of this publication.

Figure 2:
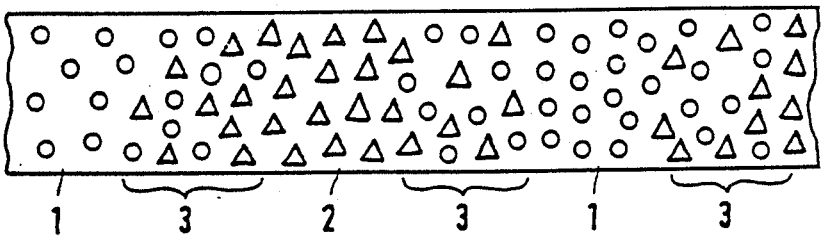

In the following, embodiments of the invention shall be described by way of example with reference to the enclosed drawing, in which FIG. 1 shows a schematic view of the arrangement of the portions and overlapping areas on a security thread, FIG. 2 shows a schematic view of the arrangement of the portions and overlapping areas, the colors being printed on by screen printing.

Figure 3:
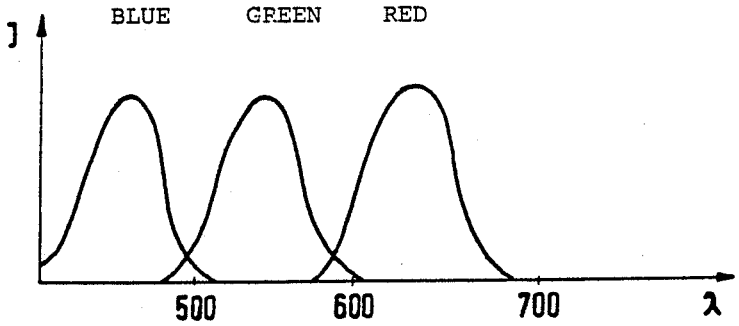
Figure 4:
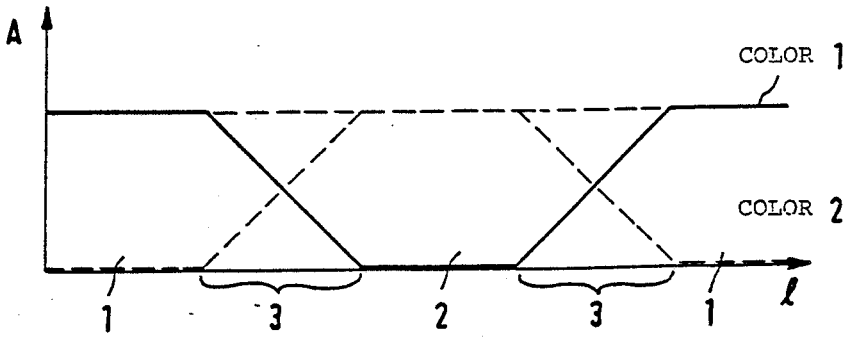

FIG. 3 shows the emission spectra of the three basic colors of the additive color mixture, and FIG. 4 shows a schematic view of the color quantity distribution over the length of the security thread for colors with the same luminosity.

The arrangement of portions 1, 2 and overlapping areas 3 is shown schematically in FIG. 1. Portion 1 is printed for example with a blue-emitting color, area 2 with a red-emitting color. The color in the overlapping areas is thus violet or magenta. If red and green are selected for the basic colors of portions 1 and 2, the resulting compound color in overlapping area 3 is yellow; if green and blue are chosen as the basic colors, the compound color in overlapping area 3 is cyanine blue, i.e. bluish-green.

FIG. 3 shows the ideal emission spectra of the three basic colors of the additive color mixture, blue, green and red; the peak intensity of blue is at about 450 nm, of green at 520 nm and of red at 690 nm. The values of the printing inks available for forgery are known to approach these curves only more or less. These colors also generally lack the necessary color purity, so that the spectrum of the compound color shifts too much, or only rather dirty color tones arise instead of the compound color.

If the basic colors red, green, blue are chosen for successive portions 1, 2, 1, the overlapping areas have the compound colors yellow, bluish-green (cyanine blue) and violet (magenta). The order of colors corresponds to the order of colors that is obtained by a prismatic decomposition of white daylight or also occurs in the rainbow. The esthetic effect of such a thread is particularly impressive.

Compound colors can of course also be used in principle. Due to the above-mentioned problems, however, it is extremely difficult to put together matching compound colors which result in sufficiently pure and characteristic mixed fluorescences in the overlapping area. But once such a suitable color combination has been found, it is virtually impossible for outsiders, and thus forgers, to recreate it.

FIG. 4 shows schematically the color quantity distribution over the length of the thread as it should ideally be selected for colors having the same luminosity. In overlapping area 3 the quantity of color 1 is reduced continuously from a constant maximum value to zero, while color 2 is at the same time increased continuously from zero to this value. Added up, this results in a constant quantity of color and smooth, continuous color transitions to the colors of adjacent areas 1 and 2.

If colors of different luminosities are used, the quantity of color can be set appropriately to regulate the luminosity. Since the fluorescence intensity of a printing ink also depends within certain limits on the quantity of color or layer thickness, a higher quantity of color must be selected for less luminous colors and vice versa. One obtains a particularly impressive esthetic impression if all colors used have approximately the same luminosity. This also provides the forger with a further obstacle to overcome, since it is hardly possible to match the intensities or to reproduce the necessary layer thicknesses without the corresponding expert knowledge.

An expert has no insurmountable difficulties in putting together the colors, provided he is equipped with sufficient printing means and knowledge. To determine the particular layer thicknesses required, he will thus print, e.g. by screen printing, so-called "color intensity wedges" in which the layer thickness, and thus the fluorescence intensity, increases continuously or in steps from a minimum to a maximum layer thickness. Once such intensity wedges exist for each basic color, they must only be shifted relative to each other in UV light and covered by a common slotted mask until matching intensities lie beside each other. Once such matching intensities are determined, an expert also has the necessary layer thicknesses therefor. These layer thicknesses can then be reproduced using the knowledge familiar to an expert but not necessarily accessible to a forger.

The aforesaid method can be used for matching both inhomogeneous color surfaces and color surfaces produced by screen printing.

FIG. 2 shows schematically another variation of the inventive security thread. Basic colors 1 and 2 are not distributed homogeneously on the carrier but are only printed on in a grid-like manner in the form of individual dots of color. Dots of both colors, i.e. basic colors 1 and 2, are present in overlapping areas 3, creating the impression of a compound color when viewed from some distance. The dots of color are naturally so small and so close together that they are virtually indistinguishable to the naked eye.

The particular density of the dots of color in the overlapping areas can decrease continuously toward the end of the portion, in accordance with FIG. 4, while the density of the dots in the next overlapping portion increases coontinuously from zero to a certain value. This means that the resulting compound color does not pass into the colors of the adjacent portions abruptly, but smoothly and continuously.

The security threads are produced in the known manner, i.e. by printing strip shapes on flat sheets and then cutting them up. It is also possible to print on individual threads, but this is unfavorable for large-scale production. The printing technique to be applied depends on the carrier materials used and the properties of the printing ink. Screen process printing techniques are suitable in particular because they allow for especially easy regulation of the quantity of ink. However, it is also possible to overprint predefined, uniform layer thicknesses locally several times.

The printing ink can also be applied by methods other than printing. It can be applied, for example, by spraycoating or free-jet spraying. The layer thicknesses are thereby adjusted by the size of the spray nozzles, the spraying time, repeated spraying, etc.

A suitable carrier material for the security thread is basically any tear-proof synthetic material. The tear strength is important since the security thread is subjected to high mechanical stress during embedding in the security paper. Transparent polyester film has proved useful in this connection. If the carrier material is transparent, one need not worry about constant orientation of the security thread during embedding, since the emitted colors are also recognizable from the back of the security thread through the carrier material. If an opaque carrier material is used, however, one must make sure the security thread has constant orientation in the paper if the fluorescent effects are to appear on the same side in all security papers; otherwise the carrier material must be printed on both sides.

The security threads can of course have, along with the colored areas, other characteristic features which are additionally evaluated by an authenticity test. One may use, for example, features that can only be detected by machines, such as metallic or electrically conductive intermediate layers or magnetic embeddings.

The security thread is also embedded in the paper in the known manner, for example by feeding the thread to the vat of a cylinder mold machine. It may be useful for the thread to be covered at least on one side by a relatively thin paper layer if the color effect is dampened too much by the paper layer. It is also possible to embed the thread with interruptions by windows for this purpose. Such a method is described, for example, in DE-A 36 01 114.

I claim:

1. A security paper, in particular a bank note, having embedded therein, running from edge to edge, a security thread that is printed with luminescent colors, wherein the luminescent colors are colorless and transparent or paper-colored in the unexcited state and wherein along the security thread there are successive and overlapping portions which, when the colors are excited, have a length recognizable to the naked eye and are each printed with a different luminescent color, so that a characteristic compound color results in the overlapping areas.

2. A security paper according to claim 1, wherein the compound color of the overlapping area runs smoothly and continuously into the colors of the portions including the overlapping area.

3. A security paper according to claim 1, wherein the luminescent colors are selected in such a way that the successive portions have basic colors of the additive color mixture and the particular, substantially pure compound colors result in the overlapping areas.

4. A security paper according to claim 3, wherein the fluorescent colors contain phosphors which emit red, green and/or blue light and the overlapping areas appear orange, green and/or violet.

5. A security paper according to claim 4, wherein the portions are printed red, green and blue so that the succession of colors in the portions and overlapping areas corresponds to the order of color in the natural spectrum.

6. A security paper according to claim 5, wherein the overlapping of the portions is selected in such a way that the length of the overlapping areas showing compound color corresponds to the length of the non-overlapping portions showing basic colors.

7. A security paper according to claim 1, wherein two colors are printed on top of each other in the overlapping areas.

8. A security paper according to claim 7, wherein at the beginning and end of each portion the particular quantity of color decreases continuously, so that in the overlapping areas there is approximately the same quantity of color altogether as in the portions.

9. A security paper according to claim 1, wherein two colors are printed into each other in a grid-like manner in the overlapping areas.

10. A security paper according to claim 9, wherein at the beginning and end of each portion the grid density decreases continuously, so that the overlapping areas have approximately the same grid density altogether as the portions.

11. A security paper according to claim 1, wherein the luminescent colors are selected so as to have high color purity and approximately the same luminosity with the same quantity of color.

12. A security paper according to claim 1, wherein the quantity of color in the portions is dosed in accordance with the particular luminosity of the colors so as to result in constant luminosity results over the length of the thread.

13. A security paper according to claim 1, wherein the luminescent colors contain phosphorescent phosphors and the afterglow time varies in the basic colors used.

14. A security paper according to claim 1, wherein the carrier material of the security thread is transparent.

15. A security paper according to claim 2, wherein the luminescent colors are selected in such a way that the successive portions have basic colors of the additive color mixture and the particular, substantially pure compound colors result in the overlapping areas.

* * * * *